United States Patent [19]

DiClemente

[11] Patent Number: 4,764,130

[45] Date of Patent: Aug. 16, 1988

[54] ELECTRICAL CONNECTOR HAVING TERMINAL HOUSING RETAINING MEMBER

[75] Inventor: Thomas J. DiClemente, Hershey, Pa.

[73] Assignee: AMP Incorporated, Harrisburg, Pa.

[21] Appl. No.: 464,460

[22] Filed: Feb. 7, 1983

[51] Int. Cl.[4] ..... H01R 13/508

[52] U.S. Cl. ..... 439/686; 439/701

[58] Field of Search ..... 339/136, 217 S, 252 R; 439/686, 689, 695, 701, 744, 871, 904

[56] References Cited

U.S. PATENT DOCUMENTS

| | | | |
|---|---|---|---|
| 2,724,811 | 11/1955 | Poupitch | 339/217 S |
| 3,112,149 | 11/1963 | Bachman | 339/217 S |
| 3,160,459 | 12/1964 | Greco et al. | 339/217 S |
| 3,547,274 | 12/1970 | Sosinkski | 211/89 |
| 3,671,921 | 6/1972 | Baker, III et al. | 339/59 M |
| 3,993,394 | 11/1976 | Cooper | 339/136 M |

FOREIGN PATENT DOCUMENTS 2123622 8/1972 France .

*Primary Examiner*—Gil Weidenfeld
*Assistant Examiner*—Gary F. Paumen

[57] ABSTRACT

An electrical connector includes a connector housing having a passageway extending therethrough in which a terminal housing is disposed. The terminal housing engages a stop surface in the passageway limiting the forward movement of the terminal housing in the passageway. A retaining member has a transverse section seated in an aperture in the connector housing. Retaining legs extend outwardly from the transverse section and inwardly into the connector housing passageway into engagement with a transverse rib on the terminal housing to retain the terminal housing in position in the passageway against the stop surface. Spring legs and projections extend outwardly from the retaining member and engage an inside surface of the connector housing adjacent the aperture thereby retaining the retaining member in position in the aperture and on the connector housing and the spring legs coupled with the retaining legs providing spring operation for the retaining member.

11 Claims, 3 Drawing Sheets

ELECTRICAL CONNECTOR HAVING TERMINAL HOUSING RETAINING MEMBER

This invention relates to electrical connectors and more particularly to retaining members for retaining terminal housings within connector housings.

BACKGROUND OF THE INVENTION

U.S. Pat. No. 3,993,394 discloses a connector housing in a passageway of which is positioned a terminal housing against a forward stop. A retaining member has a transverse section seated in an aperture in the connector housing. First leg members extend outwardly from the transverse section and have first sections extending along an inside surface of the housing forward of the aperture and second sections cantilevered from the inside surface which extend toward the axis and toward the front end of the connector housing with free ends of the leg members engaging a transverse rib on the terminal housing thereby retaining the terminal housing in the opening. Second leg members also extend outwardly from the transverse member in the same direction as the first members; they are planar and longer than the first leg members, extend along the inside surface of the connector housing and have free ends disposed in slots in the forward stop. The second leg members are formed with a slight bend to provide a spring bias when inserted in the slots tending to hold the retaining member in place.

One problem with this arrangement is the difficulty in positioning the ends of the second leg members in the slots due to their bent form and their length which makes it difficult to position the retaining member in the connector housing. The first leg members perform dual functions of retaining the terminal housing in the connector housing and retaining the retaining member in position in the connector housing. The short length of the second sections of the first leg members provides substantially stiff sections that make it difficult to insert the terminal housing in or remove it from the connector housing. Moreover, extreme angles of the parts of the retaining member and severe forming operations to form the retaining member require more expensive material and also results in lower productivity and higher tooling costs and repairs thereof.

SUMMARY OF THE INVENTION

According to the present invention, an electrical connector includes a connector housing having a passageway extending therethrough in which a terminal housing is disposed. The terminal housing engages a stop surface in the passageway limiting the forward movement of the terminal housing in the passageway. A retaining member has a transverse section seated in an aperture in the connector housing. Retaining legs extend outwardly from the transverse section and inwardly into the connector housing passageway into engagement with a transverse rib on the terminal housing to retain the terminal housing in position in the passageway against the stop surface. Spring legs and projections extend outwardly from the retaining member and engage an inside surface of the connector housing adjacent the aperture thereby retaining the retaining member in position in the aperture and on the connector housing and providing spring operation for the retaining member.

DETAILED DESCRIPTION OF THE INVENTION

Figure 4:
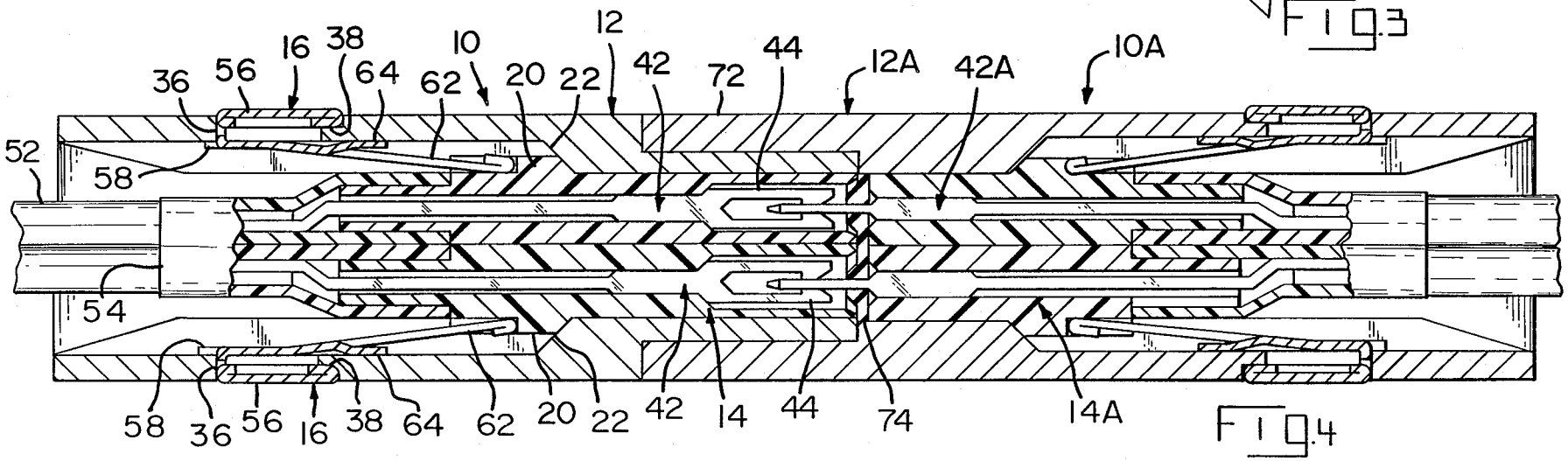
FIG. 4 is a view similar to FIG. 3 showing the assembled electrical connectors in mated electrical connection.

As shown in the drawings, electrical connector 10 comprises a connector housing 12, terminal housings 14, and retaining members 16. Connector housing 12 is made of a suitable metal and is formed in accordance with conventional casting practices; however, it can be molded of a suitable plastic material or part plastic material which can be metal plated if desired. A passageway 18 extends through connector housing 12 and receives therein terminal housings 14 as shown in FIG. 4. As can be discerned, the forward ends of terminal housings 14 fit snugly within the forward end of passageway 18 with the sloped forward surfaces of transverse ribs 20 on terminal housings 14 disposed adjacent stop surfaces 22 in passageway 18 to limit movement of terminal housings 14 within passageway 18. Mounting members 24 extend outwardly from the rear surface of connector housing 12 and they have holes 26 extending therethrough. Mounting screws 28 are freely mountable in holes 30 located in side projections 32 of housing 12 and mounting screws 28 are retained in position by retaining rings 34. Openings 36 are located in the top and bottom surfaces of housing 12 and are in communication with passageway 18.

Terminal housings 14 are in the form of rectangular wafers which have smooth inner surfaces that engage one another with transverse ribs 20 on the outer surfaces. Profiled passageways 40 extend through terminal housings 14 and have secured therein electrical terminals 42 with fork contact sections 44 and conductor-securing sections 46 extending outwardly from annular projections that are located at the rear surface of terminal housings 14. Electrical wires 50 of insulated conductors 52 are respectively soldered to conductor securing sections 46 of electrical terminals 42 and heat shrinkable sleeves 54 are shrunk onto annular projections 48 and insulated conductors 52 thereby sealing the terminations between electrical wires 50 and conductor-securing sections 46. If desired, electrical wires 50 can be crimped to conductor-securing sections 46 in accordance with conventional crimp terminating practices with or without conventional heat shrinkable sleeves 54 heat shrunk onto annular projections 48 and the insulation of conductors 52.

Figure 1:
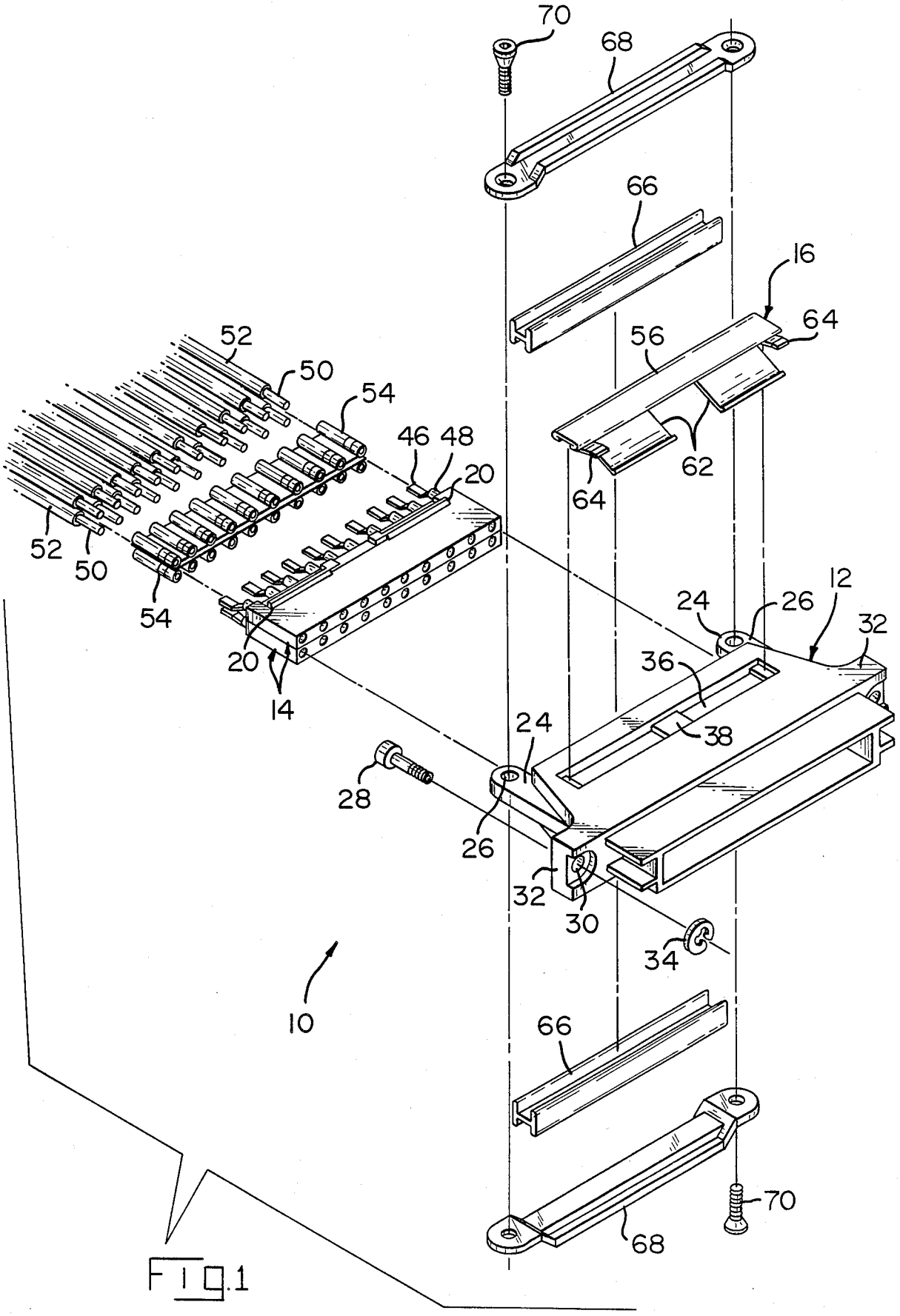
FIG. 1 is a perspective and exploded view of the parts of the electrical connector.
Figure 3:
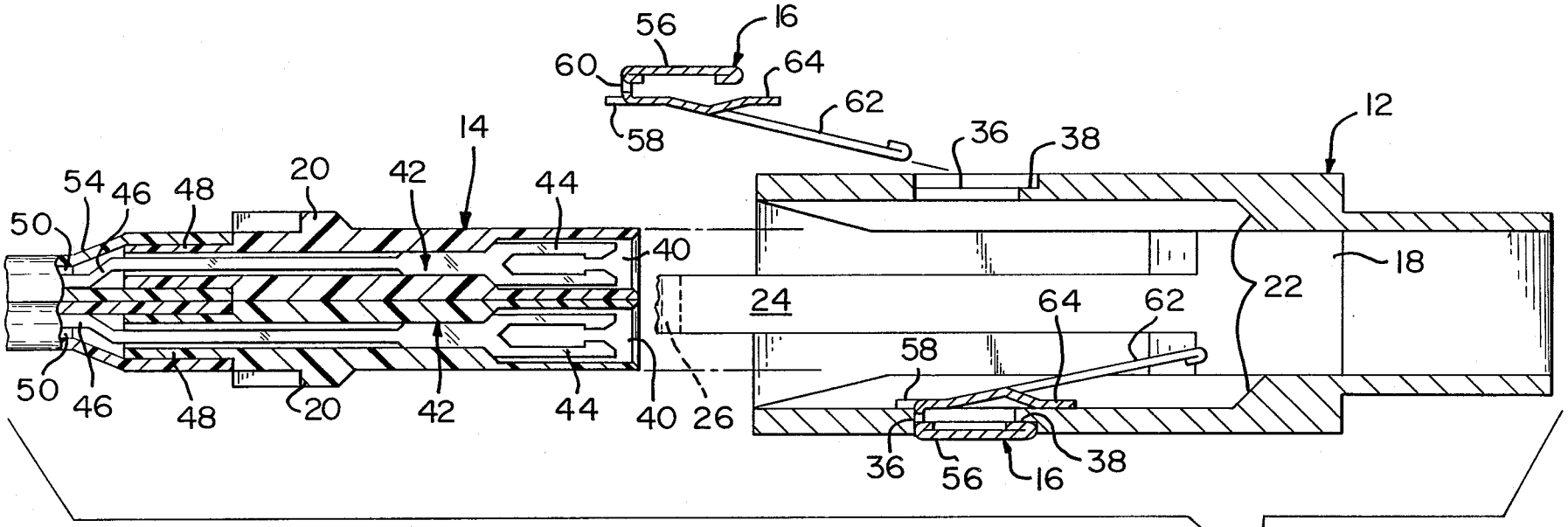
FIG. 3 is a cross-sectional view of the electrical connector showing a retaining member and terminal housings outside a connector housing prior to being assembled together.
Figure 5:
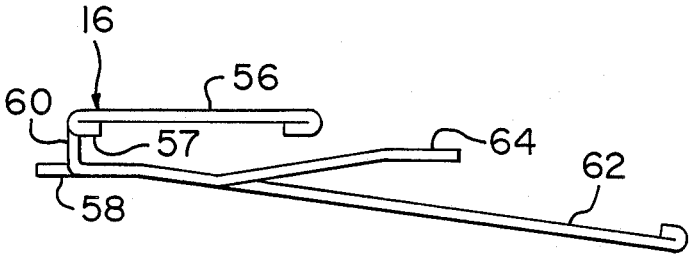
FIG. 5 is a side elevational view of the retaining member.
Figure 6:
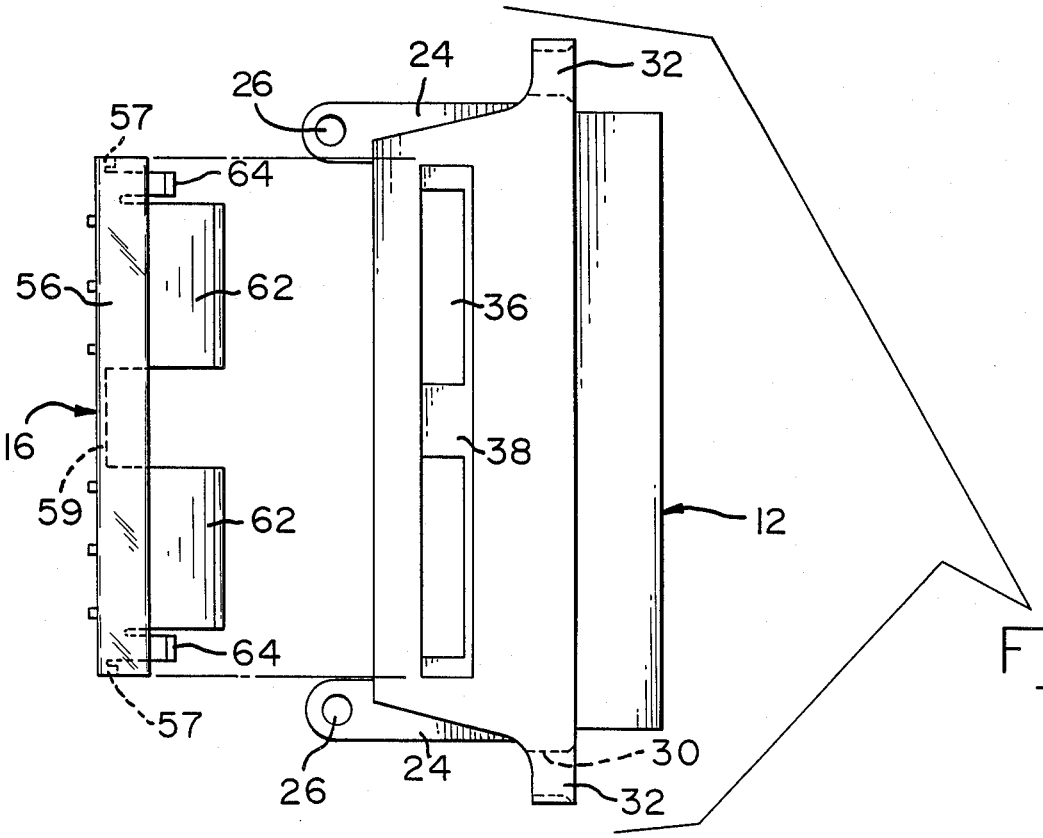
FIG. 6 is an exploded top plan view of the retaining member and connector housing prior to being assembled together.

Retaining members 16 are stamped and formed from a suitable member having desirable spring characteristics such as, for example, stainless steel, and they include a transverse section 56 that has the forward end folded back on itself which fits into openings 36 in engagement with supporting surfaces 38 in openings 36 as shown in FIGS. 3 and 4, supporting surfaces 38 defining a seat area. Projections 58 are stamped from a bight section 60 and they extend outwardly from bight section 60 in a rearward direction. Retaining leg members 62 extend outwardly from bight section 60 as planar members and outwardly and forwardly relative to transverse section 56 with the free ends being bent back upon the leg members to reinforce them and provide smooth and radiussed free ends. Spring leg members 64 are located outwardly from retaining leg members 62 as shown in FIG. 6 and they extend from bight section 60 in a forward direction therefrom and are substantially parallel to transverse section 56 while having a slight V-shaped form in cross section as shown in FIGS. 3 through 5. The outer ends 57 and 59 of the trailing edges of transverse section 56 are bent in engagement with the transverse section and engage supporting surfaces 38 in openings 36.

Retaining members 16 are inserted into position in openings 36 of connector housing 12 by slightly tilting retaining members 16 so that retaining leg members 62 and spring leg members 64 extend into profiled passageway 18 through openings 36 and moving the leading part of transverse section 56 slightly beyond openings 36 along the top and bottom surfaces of housing 12. This enables projections 58 to clear the rear surfaces of openings 36 and be moved into passageway 18 through openings 36 by tilting retaining members 16 in an upward direction. When projections 58 are disposed within passageway 18, retaining members 16 are moved backwardly until bights 60 engage the rear surfaces of openings 36 which moves projections 58 into engagement with the inner surfaces of passageway 18 adjacent openings 36. Transverse section 56 engages supporting surfaces 38 along the sides and front surfaces of openings 36 including the central supporting surfaces and spring leg members 64 engage along the inner surfaces of passageway 18 adjacent the front surfaces of openings 36 as shown in FIGS. 3 and 4. In this position, retaining members 16 are ready to permit terminal housings 14 to be moved into profiled passageway 18 with the front sloped surfaces of transverse ribs 20 camming retaining leg members 62 upwardly until the front sloped surfaces of transverse ribs 20 engage stop surfaces 22 in profiled passageway 18 whereupon retaining leg members 62 move into engagement with the rear flat surfaces of transverse ribs 20 thereby retaining terminal housings 14 in position in profiled passageway 18 as illustrated in FIG. 4.

Projections 58 and spring leg members 64 maintain retaining members 16 in position in openings 36 of connector housing 12 and this enables retaining leg members 62 to function as stiff springs to retain terminal housings 14 in position in passageway 18 as stiff retaining members thereby increasing the retaining forces on terminal housings 14 in conjunction with spring leg members 64 thereby providing the necessary spring forces for retaining member 16. A tool (not shown) can be inserted in passageway 18 to move leg members 62 free of transverse ribs 20 thereby enabling terminal housings 14 to be removed from passageway 18. When retaining leg members 62 are moved toward the inner adjacent surfaces of passageway 18 by engagement with transverse ribs 20 during insertion of terminal housings 14 within passageway 18, and when they are moved by engagement with the removal tool to remove terminal housings from housing 12, such movement causes retaining members 16 to pivot slightly within openings 36 with spring leg members 64 providing the spring forces for leg members 62. In this way, spring leg members 64 provide the spring operation for retaining members 16.

Figure 2:
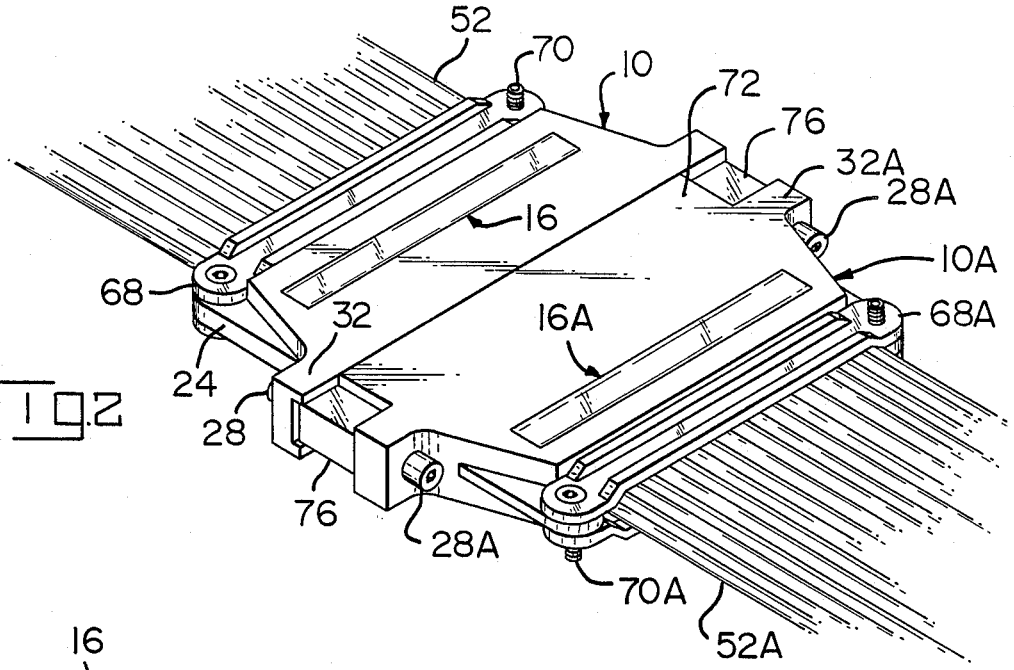
FIG. 2 is a perspective view of the electrical connector in an assembled condition.

After terminal housings 14 have been secured in position in profiled passageway 18 of connector housing 12 by retaining members 16, flexible members 66 having an l-shape in cross section are positioned in engagement with conductors 52 and brackets 68 are positioned onto flexible members 66 and secured in position on mounting members 24 by screws 70. This arrangement provides a strain relief for conductors 52 as shown in FIG. 2. In practice, flexible members 66 can be secured to brackets 68 to form unitary members.

FIGS. 2 and 4 illustrate complementary electrical connectors 10 and 10A interconnected together. As can be discerned, connectors 10 and 10A are identical with the exception that connector 10 is a plug and connector 10A is a receptacle, and connector 10A has a hood section 72 which encompasses a front section of connector housing 12 as illustrated in FIG. 4. A sealing member 74 surrounds the contact sections of electrical terminals 42A in electrical connector 10A thereby forming a seal between the contact sections of electrical terminals 42 and 42A when they are interconnected. Thus terminal housings 14 of electrical connector 10 and terminal housings 14A of electrical connector 10A are retained in position in profiled passageways 18 and 18A of respective connector housings 12 and 12A by retaining members 16 and 16A as illustrated in FIG. 4, and electrical connectors 10 and 10A are maintained in matable engagement via mounting screws 28 and 28A threadably secured in block members 76 as shown in FIG. 2.

As can be discerned, unique retaining members have been disclosed for retaining terminal housings in passageways of metal or plastic or metal-plated plastic connector housings that retain the terminal housings in the passageways with excellent retention forces and the retaining members have optimum spring characteristics to enable ease of insertion of the terminal housings in the passageways as well as removal therefrom. Moreover, the retaining members can be formed from less expensive metal having the desirable retention and spring characteristics and using less severe forming operations resulting in greater productivity and lower tool wear.

I claim:

1. An electrical connector of the type comprising a connector housing having a passageway extending therethrough and defining an inside surface of said connector housing, a terminal housing having electrical terminals disposed therein positioned in said passageway against a stop surface in the passageway, said connector housing having an aperture in communication with the passageway and including a seat area, a retaining member having a transverse section disposed in said aperture in engagement with the seat area, and retaining leg members extending outwardly from the transverse section forwardly toward a front end of the passageway, and inwardly toward a longitudinal axis of the passageway in engagement with a transverse rib on the terminal housing, characterized in that said transverse section having spring legs extending outwardly from said transverse section in a first direction and in engagement with first portions of said inside surface of the connector housing adjacent the aperture and projections extending outwardly from said transverse section in a second opposition direction and in engagement with second portions of said inside surface of the connector housing adjacent the aperture, whereby the combination of said spring legs and said projections retain the retaining member in position in the aperture.

2. An electrical connector as set forth in claim 1, characterized in that said retaining member has a bight section from which said projections extend in a rearward direction and from which said retaining leg members and said spring legs extend in a forward direction.

3. An electrical connector as set forth in claim 2, characterized in that said spring legs are substantially parallel with respect to said transverse section and are shorter than said retaining leg members.

4. An electrical connector as set forth in claim 3, characterized in that said spring legs are disposed outwardly from said retaining leg members and have a slight V-shape in cross section.

5. An electrical connector, comprising:

connector housing means having passageway means extending therethrough, said connector housing means having wall means through which aperture means including seat means extends, stop means located in said passageway means;

retaining means having transverse section means disposed in said aperture means in engagement with said seat means, retaining leg means extending outwardly from said transverse section means forwardly toward a front end of said passageway means and inwardly toward a longitudinal axis of said passageway means, spring leg means exending outwardly from said transverse section means forwardly toward the front end of the passageway means and extending substantially parallel with respect to said transverse section means, projection means extending rearwardly from said transverse section means, said projection means and said spring leg means engaging an inner surface of said passageway means adjacent said aperture means thereby maintaining said retaining means in said aperture means with said spring leg means coupled with said retaining leg means providing spring operation for said retaining leg means;

terminal housing means disposed in said passageway means and having electrical terminal means secured therein for electrical connection with electrical conductor means, transverse rib means extending across an outer surface of said terminal housing means for engagement with said stop means to limit movement of said terminal housing means in said passageway means and for engagement by said retaining leg means to maintain said terminal housing means in said passageway means.

6. An electrical connector as set forth in claim 5 wherein said spring leg means are disposed outwardly from said retaining leg means on each side thereof.

7. An electrical connector as set forth in claim 5 wherein said spring leg means have a slight V-shape in cross section.

8. An electrical connector as set forth in claim 5 wherein said retaining means has bight section means from which said retaining leg means, said spring leg means, and said projection means extend.

9. An electrical connector as set forth in claim 5 wherein said retaining leg means are substantially planar from said bight section means to free ends thereof.

10. An electrical connector as set forth in claim 5 wherein the outer ends of said spring leg means are planar.

11. An electrical connector of the type comprising a connector housing having a passageway extending therethrough and defining an inside surface of said connector housing, a terminal housing having electrical terminals disposed therein positioned in said passageway against a stop surface in the passageway, said connector housing having an aperture in communication with the passageway and including a seat area, a retaining member having a transverse section disposed in said aperture in engagement with the seat area, and retaining leg members extending outwardly from the transverse section forwardly toward a front end of the passageway, and inwardly toward a longitudinal axis of the passageway in engagement with a transverse rib on the terminal housing, characterized in that said transverse section having spring legs extending outwardly from said transverse section in a first direction and in engagement with first portions of said inside surface of the connector housing adjacent the aperture and projections extending outwardly from said transverse section in a second opposition direction and in engagement with second portions of said inside surface of the connector housing adjacent the aperture, whereby the combination of said spring legs and said projections retain the retaining member in position in the aperture, and in that a bight section separates said transverse section of said retaining member from the retaining leg members, the spring legs and the projections thereof, such that at least the transverse section, the springs legs and the projections are substantially parallel to each other; and the combination of the transverse section, bight section and spring legs is U-shaped in side elevation.

* * * * *